US008771433B2

(12) United States Patent
Gray et al.

(10) Patent No.: US 8,771,433 B2
(45) Date of Patent: Jul. 8, 2014

(54) DISHWASHER WITH AN ALARM DEVICE

(75) Inventors: Alex Gray, Monterey (AU); Bernd Krische, Saltsjö-Boo (SE)

(73) Assignee: Electrolux Home Products Corporation, N.V., Zaventem (BE)

( * ) Notice: Subject to any disclaimer, the term of this patent is extended or adjusted under 35 U.S.C. 154(b) by 1116 days.

(21) Appl. No.: 12/514,530

(22) PCT Filed: Nov. 22, 2007

(86) PCT No.: PCT/EP2007/062722

§ 371 (c)(1),
(2), (4) Date: Apr. 8, 2010

(87) PCT Pub. No.: WO2008/074590

PCT Pub. Date: Jun. 26, 2008

(65) Prior Publication Data

US 2010/0206342 A1 Aug. 19, 2010

(30) Foreign Application Priority Data

Nov. 23, 2006 (EP) ..... 06124677

(51) Int. Cl.

| | |
|---|---|
| ***A47L 15/00*** | (2006.01) |
| ***A47L 15/22*** | (2006.01) |
| ***A47L 15/46*** | (2006.01) |
| ***A47L 15/50*** | (2006.01) |

(52) U.S. Cl.
USPC ... 134/57 D; 134/56 D; 134/58 D; 134/115 R

(58) Field of Classification Search
USPC ..... 134/115 R
See application file for complete search history.

(56) References Cited

U.S. PATENT DOCUMENTS

| | | | | | |
|---|---|---|---|---|---|
| 3,064,662 | A * | 11/1962 | Given et al. | ..... | 134/95.2 |
| 3,190,709 | A * | 6/1965 | Dutcher et al. | ..... | 312/228 |
| 4,408,195 | A * | 10/1983 | Tullis et al. | ..... | 340/685 |
| 6,295,004 | B1 * | 9/2001 | Burnett | ..... | 340/686.1 |
| 6,447,081 | B1 * | 9/2002 | Sargeant et al. | ..... | 312/228.1 |
| 6,761,179 | B2 * | 7/2004 | Rosenbauer et al. | ..... | 134/113 |
| 7,134,211 | B2 * | 11/2006 | Bascom et al. | ..... | 33/286 |
| 2007/0181162 | A1 * | 8/2007 | Classen et al. | ..... | 134/25.2 |

FOREIGN PATENT DOCUMENTS

| | | | | |
|---|---|---|---|---|
| DE | 40 18 048 | A1 | 12/1991 | |
| DE | 197 04 496 | A1 | 3/1998 | |
| DE | 200 16 729 | U1 | 12/2000 | |
| DE | 197 04 496 | C2 | 2/2001 | |
| DE | 100 48 081 | A1 | 4/2002 | |
| DE | 100 48 086 | A1 | 4/2002 | |
| DE | 101 62 505 | A1 | 7/2003 | |
| EP | 0 943 287 | A1 | 9/1999 | |
| EP | 1 192 893 | A2 | 4/2002 | |
| WO | WO 2006015934 | A1 * | 2/2006 | ..... A47L 15/42 |

* cited by examiner

*Primary Examiner* — Joseph L Perrin
*Assistant Examiner* — Levon J Shahinian
(74) *Attorney, Agent, or Firm* — Alston & Bird LLP

(57) ABSTRACT

A dishwasher (1) (30) having a box-shaped casing (2) having an inner wash chamber (3) communicating externally through an opening (4) formed in one of the lateral walls of the casing (2); and at least one dish rack basket (6) housed inside the wash chamber (3) to house dishes/cutlery within a hold volume (7) bounded by two predetermined boundary planes (A, B); the dishwasher (1) having an alarm device (9) which generates, inside the wash chamber (3), at least one light beam in a direction coplanar with a reference plane (R) lying in one of the predetermined boundary planes (A, B); and the alarm device (9) alerting the user to incorrect positioning of the dishes/cutlery inside the basket (6) when the light beam is interrupted by the dishes/cutlery.

26 Claims, 11 Drawing Sheets

DISHWASHER WITH AN ALARM DEVICE

TECHNICAL FIELD

The present invention relates to a dishwasher with an alarm device.

More specifically, the present invention relates to a dishwasher with an alarm device for warning the user of incorrect positioning of dishes/cutlery inside the dish rack basket; to which the following description refers purely by way of example.

BACKGROUND ART

As is known, in currently marketed household dishwashers, incorrect positioning of dishes and/or cutlery inside the dish rack basket may result in interference with the rotary wash members mounted inside the wash chamber of the dishwasher, thus resulting in jamming of the rotary wash members and possible damage to the dishes or cutlery inside the basket.

The inconvenience of the above situation is further compounded by interference between the dishes/cutlery and the rotary wash members preventing correct performance of the wash cycle.

In which case, the user is forced to stop the wash cycle, pull the basket out of the wash chamber, and position the dishes and/or cutlery properly.

Interference as described above also occurs when the basket is loaded with dishes or cutlery over and above the predetermined size. In which case, when inserting the basket inside the wash chamber, the dishes or cutlery may be damaged by collision with the rotary wash members, and may knock the basket out of position on the respective runners. In which case, obviously, the door may be prevented from watertight closing the wash chamber, thus resulting in leakage of the wash chamber with obvious inconvenience to the user.

DISCLOSURE OF INVENTION

It is an object of the present invention to provide a dishwasher with an alarm device for warning the user of incorrect positioning of the dishes/cutlery inside the dish rack baskets of the dishwasher.

According to the present invention, there is provided a dishwasher with an alarm device as claimed in the accompanying Claims.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
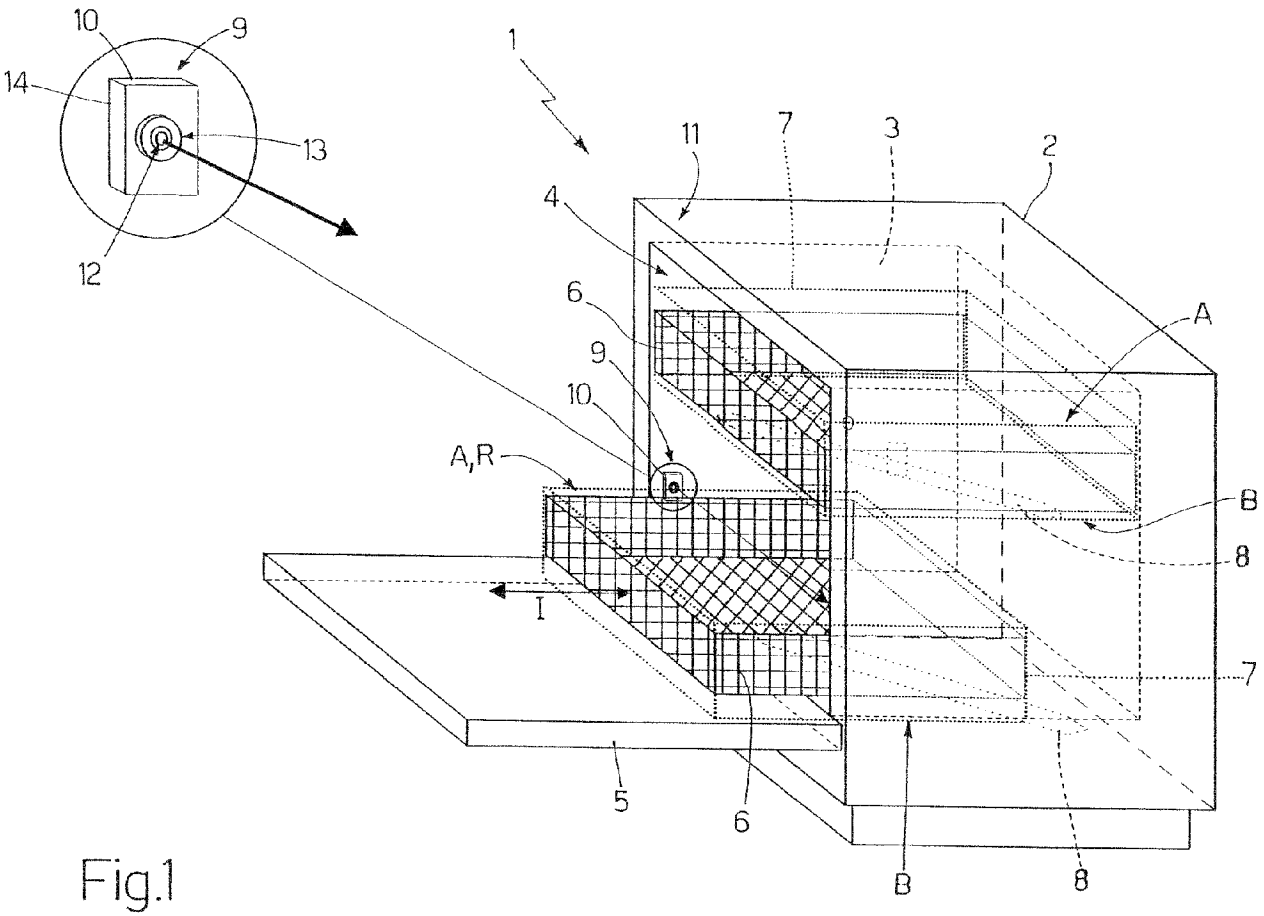
FIG. 1 shows a schematic view in perspective, with parts enlarged for clarity, of a dishwasher with an alarm device in accordance with the teachings of the present invention.

Number 1 in FIG. 1 indicates as a whole a dishwasher comprising: a box-shaped, preferably, though not necessarily, parallelepiped-shaped outer casing 2 having an inner wash chamber 3 communicating with the outside through an opening 4 formed in one of the vertical lateral walls of casing 2; and a door 5 hinged to casing 2, on one side of the access opening to wash chamber 3, to rotate, about a preferably, though not necessarily, horizontal axis of rotation, to and from a closed position resting on the lateral wall of casing 2 to seal the access opening to wash chamber 3.

Dishwasher 1 also comprises one or more dish rack baskets 6 housed one over the other inside wash chamber 3 and resting on known runners (not shown) by which to pull the baskets out drawer-fashion through access opening 4 to wash chamber 3.

Each basket 6 has a predetermined, preferably parallelepiped-shaped hold volume 7 (shown by the dotted line in FIGS. 1 and 2), the outer walls of which define a predetermined space in which to house dishes/cutlery. In other words, hold volume 7 defines a predetermined space, within which dishes/cutlery must be housed when positioned correctly, and which is therefore sized to prevent the dishes/cutlery in basket 6 from interfering with other parts or baskets of dishwasher 1.

Hold volume 7 of each basket 6 is bounded at the top and bottom by two parallel, horizontal boundary planes A and B; and intersection of at least one of the two boundary planes A and B by a dish/item of cutlery represents incorrect positioning of the dishes/cutlery inside relative basket 6.

Dishwasher 1 also comprises at least two rotary spray wash members 8 mounted for rotation inside wash chamber 3 and having a number of nozzles designed to direct pressurized-water jets onto the two baskets 6 housed inside wash chamber 3.

Figure 2:
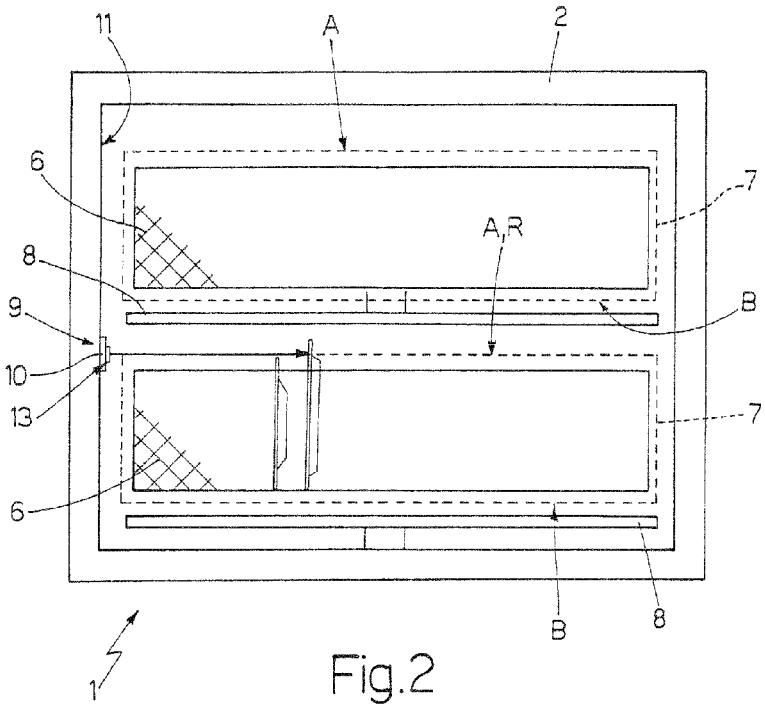
FIG. 2 shows a schematic front view, with parts removed for clarity, of the dishwasher with an alarm device in accordance with the teachings of the present invention.

More specifically, in the FIGS. 1 and 2 example, the top rotary wash member 8 is located underneath the top basket 6 and an appropriate distance from boundary plane A of hold volume 7 of the bottom basket 6; and the bottom rotary wash member 8 is located underneath bottom basket 6 and an appropriate distance from boundary plane B of hold volume 7 of bottom basket 6.

Dishwasher 1 also comprises an alarm device 9 for generating, preferably, though not necessarily inside wash chamber 3, at least one light beam along a reference plane R lying in either one of boundary planes A and B, and for alerting the user to incorrect positioning of the dishes/cutlery inside basket 6 when the light beam is interrupted by the dishes/cutlery. In other words, alarm device 9 generates at least one light beam in a direction lying in reference plane R, and alerts the user to incorrect positioning of the dishes/cutlery inside basket 6 when a portion of the dishes/cutlery projects beyond reference plane R, thus interrupting the light beam (FIG. 2).

In the FIGS. 1 and 2 example, alarm device 9 comprises a light-emitting device 10 fixed firmly to an inner lateral wall 11 of wash chamber 3 and having a spot light source which emits a light beam along reference plane R, which, in the example shown, lies in boundary plane A of bottom basket 6. Obviously, as inferred above, reference plane R may alternatively lie in either one of boundary planes B of baskets 6, or in boundary plane A of top basket 6, and alarm device 9 may comprise an emitting device 10 for each boundary plane A and B of each basket 6.

More specifically, in FIG. 1, light-emitting device 10 is fixed firmly to the outer peripheral edge of wash chamber 3 facing opening 4, and is located above bottom basket 6 and preferably crosswise with respect to the direction I in which basket 6 is inserted into and withdrawn from wash chamber 3.

Obviously the light-emitting device 10 may alternatively be located on the casing 2 outside of the wash chamber 3 on one side of the access opening to wash chamber 3, to project the light beam outside of the wash chamber 3 in a direction coplanar with reference plane R and crosswise with respect to the direction I in which basket 6 is inserted into and withdrawn from wash chamber 3.

With reference to FIG. 2, in actual use, incorrect positioning of the dishes/cutlery is indicated when, as basket 6 is inserted inside wash chamber 3, the transverse light beam is interrupted by a portion of the dishes/cutlery housed inside basket 6. In which case, the user is alerted immediately by simply observing interruption and/or reflection of the light beam by the dishes and/or cutlery which, when basket 6 is inserted inside wash chamber 3, project beyond boundary plane A, i.e. intersect reference plane R.

With reference to FIGS. 1 and 2, emitting device 10 comprises at least one LED 12 or any other similar spot light source capable of generating collimated light of a frequency preferably, though not necessarily, in the visible spectrum, e.g. a coloured light clearly visible by the user.

Convergence of the light beam emitted by LED 12 may be achieved, for example, by means of an optical module 13 having a lens and fitted to a support module 14 of LED 12 to position the lens facing LED 12 and so ensure generation of a collimated light beam corresponding, for example, to a LASER beam.

To better indicate incorrect positioning of the dishes/cutlery inside basket 6, the number of light beams emitted by emitting device 10 may be increased to cover more of reference plane R.

Figure 3:
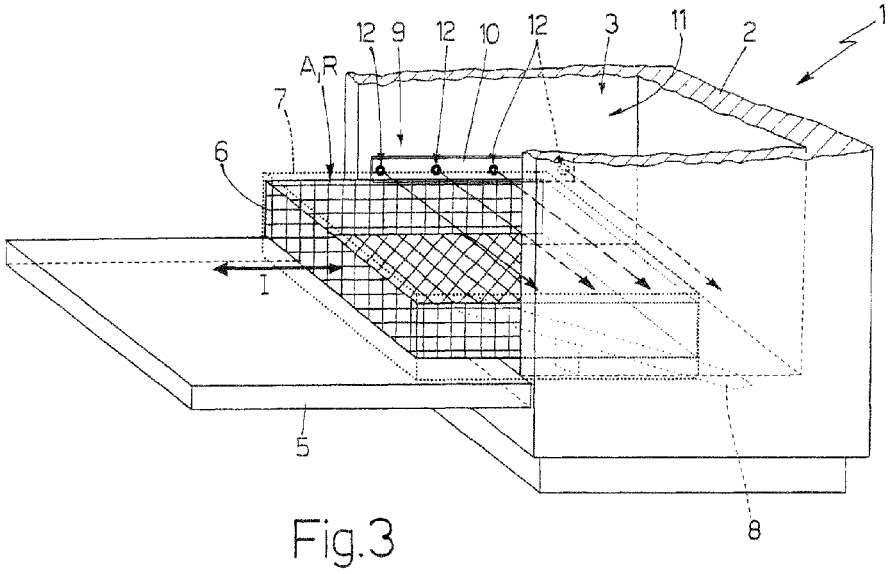
FIGS. 3, 4 and 5 show schematic views in perspective, with parts removed for clarity, of the dishwasher comprising an alarm device in accordance with respective alternative embodiments of the present invention.
Figure 4:
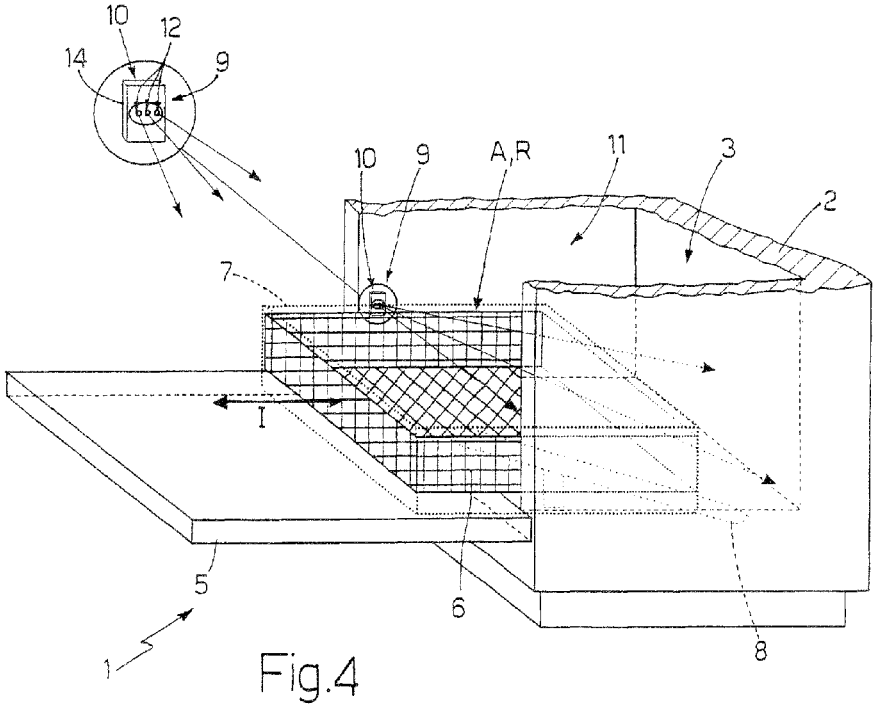

FIGS. 3 and 4 show two embodiments of alarm device 9, in which emitting device 10 generates a number of (in the examples shown, four) separate light beams in straight directions across wash chamber 3, so as to intercept any dishes/cutlery projecting beyond reference plane R.

More specifically, in the FIG. 3 embodiment, an emitting device 10 comprises a number of LEDs 12 fitted, aligned and spaced apart, to vertical lateral wall 11 of the wash chamber to emit respective parallel light beams along reference plane R.

In the embodiment shown schematically in FIG. 4, an emitting device 10 comprises a number of LEDs 12 oriented to emit respective light beams along reference plane R in different directions so as to cross wash chamber 3 at different points.

In an alternative embodiment (not shown), emitting device 15 comprises one LED 12 and a number of optical fibers (not shown) fitted, aligned and spaced apart, to vertical lateral wall 11 of the wash chamber to emit respective light beams along reference plane R.

In a further embodiment, alarm device 9 is designed to continuously and angularly vary the direction of the light beam emitted by emitting device 10. More specifically, in the FIG. 5 example, alarm device 9 comprises a device 15 for continuously varying the angle at which the light beam is emitted by LED 12 along reference plane R, so as to sweep reference plane R and indicate incorrect positioning of the dishes/cutlery upon the dishes/cutlery being intercepted by the sweeping light beam.

More specifically, device 15 controls the direction in which the light beam is emitted by LED 12 so that the angle $\alpha$ between the emission direction and vertical inner lateral wall 11 ranges between a first substantially zero angle $\alpha_1$, in which the beam direction is parallel to lateral wall 11 and coplanar with reference plane R, and a final angle $\alpha_2$, e.g. of 90°, in which the direction of the light beam is substantially perpendicular to lateral wall 11 and coplanar with reference plane R.

Figure 5:
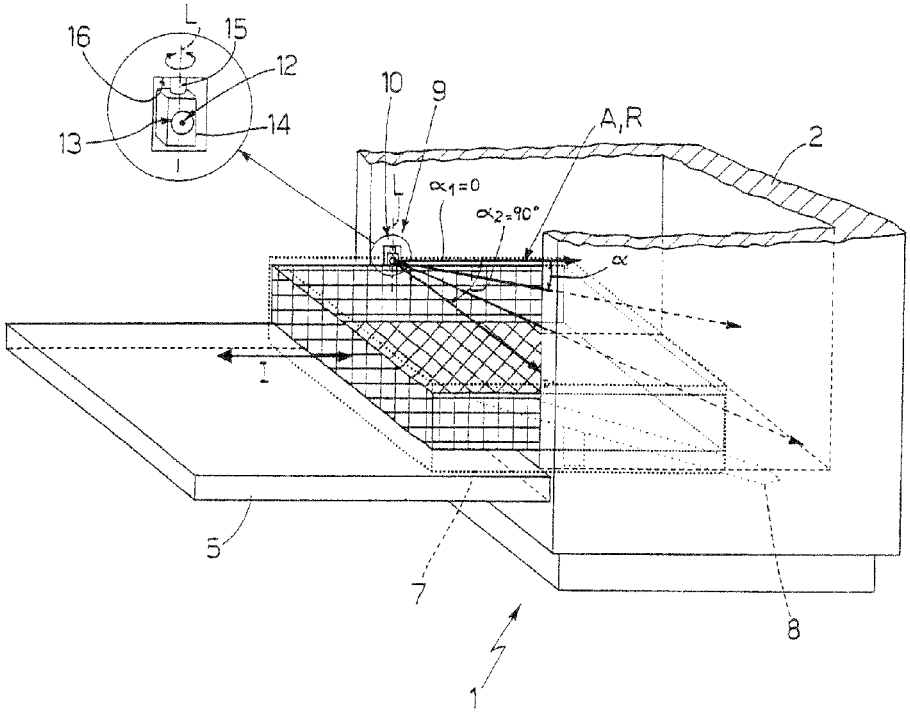

More specifically, in the FIG. 5 example, device 15 comprises an actuating device, e.g. an electric drive unit connected mechanically in known manner to support module 14 of LED 12 to rotate the support module about a longitudinal axis L, of emitting device 10, perpendicular to reference plane R and coplanar with lateral wall 11.

In the example shown, emitting device 10 may be housed in a seat 16 formed in lateral wall 11, and device 15 may be connected to the top wall of seat 16 to support and rotate LED support module 14.

In an alternative embodiment (not shown), device 15 comprises an optical reflecting system having a number of movable mirrors, which receive the beam emitted by LED 12, and are rotated about longitudinal axis L of emitting device 10 to vary the angle of incidence of the light beam on the mirrors and, hence, the direction of the light beam inside wash chamber 3, in the same way as shown in FIG. 5.

Figure 6:
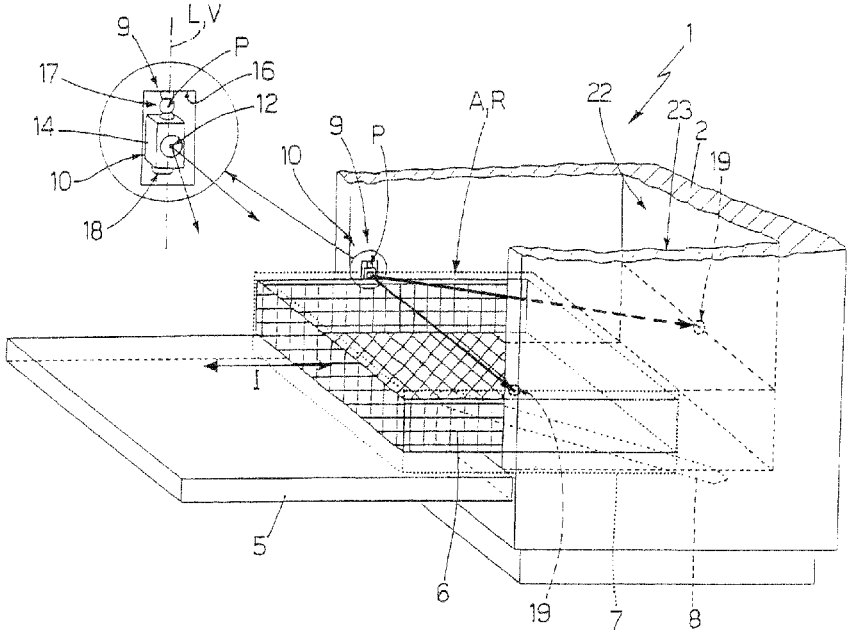
FIG. 6 shows a schematic view in perspective, with parts removed for clarity, of the dishwasher comprising an alarm device in accordance with an alternative embodiment of the present invention.

In a further embodiment shown in FIG. 6, emitting device 10 is housed inside seat 16 formed in lateral wall 11, and, in addition to support module 14 supporting LED 12, also comprises a connecting member 17, which may be defined by a spherical joint or a supporting arm connecting support module 14 to the top wall of seat 16 at a connecting point P, and allows support module 14 to oscillate freely in any direction with respect to connecting point P.

Figure 7:
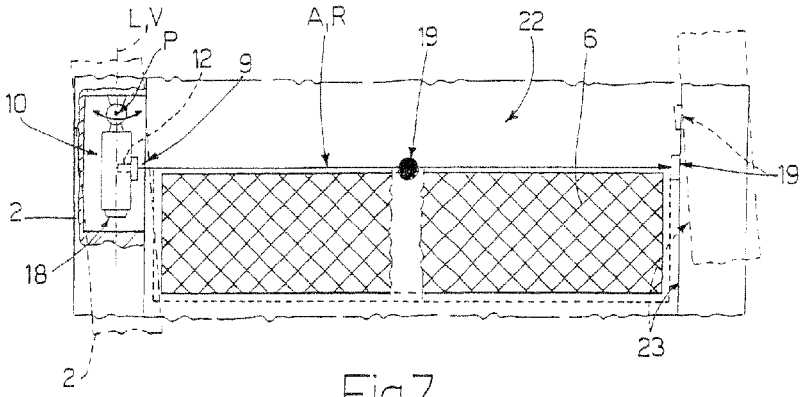
FIG. 7 shows a schematic front view of a portion of the FIG. 6 dishwasher in two different on-floor positions.

In the FIGS. 6 and 7 example, emitting device 10 also comprises a weight 18 preferably fixed firmly to the underside of support module 14 to keep emitting device 10 positioned, by force of gravity, with its longitudinal axis L coaxial with a vertical reference axis V, regardless of the position of casing 2 of dishwasher 1.

Emitting device 10 therefore oscillates freely with respect to connecting point P, so that its longitudinal axis L is coaxial with vertical reference axis V, and the direction/s of the light beam/s generated by emitting device 10 are always perfectly horizontal, regardless of the position in which dishwasher 1 rests on the floor.

With reference to FIGS. 6 and 7, alarm device 9 also comprises at least two reference elements 19 fixed to the inner walls of wash chamber 3 at two points, each corresponding with a condition in which dishwasher 1 is supported correctly on the floor. More specifically, each reference element 19 corresponds with a point of incidence of a light beam on a respective wall when dishwasher 1 is supported correctly, i.e. substantially horizontally, on the floor.

In actual use, when the point of incidence of one of the light beams emitted by emitting device 10 fails to coincide with a corresponding reference element 19, the user is alerted that dishwasher 1 is not supported correctly on the floor.

In the FIG. 6 example, emitting device 10 of alarm device 9 emits at least two light beams in diverging directions onto two contiguous, perpendicular lateral walls 22 and 23 of wash chamber 3, to which two respective reference elements 19 are fixed.

Improper support of dishwasher 1 may obviously also be indicated by rotating a light beam about longitudinal axis L and in reference plane R, and determining whether or not the trajectory defined by the points of incidence of the light beam on the walls of wash chamber 3 intersects both reference elements 19.

Reference elements 19 may comprise stickers or any other visible marks fixed to/formed on lateral walls 22 and 23 at the points of incidence of the light beams corresponding to correct on-floor support of dishwasher 1.

In a further embodiment, in addition to emitting device 10, alarm device 9 also comprises a detecting unit 20, which detects interruption of the light beam emitted by emitting device 10 preferably, though not necessarily inside wash chamber 3, and generates an alarm signal indicating incorrect positioning of the dishes/cutlery inside basket 6.

Figure 8:
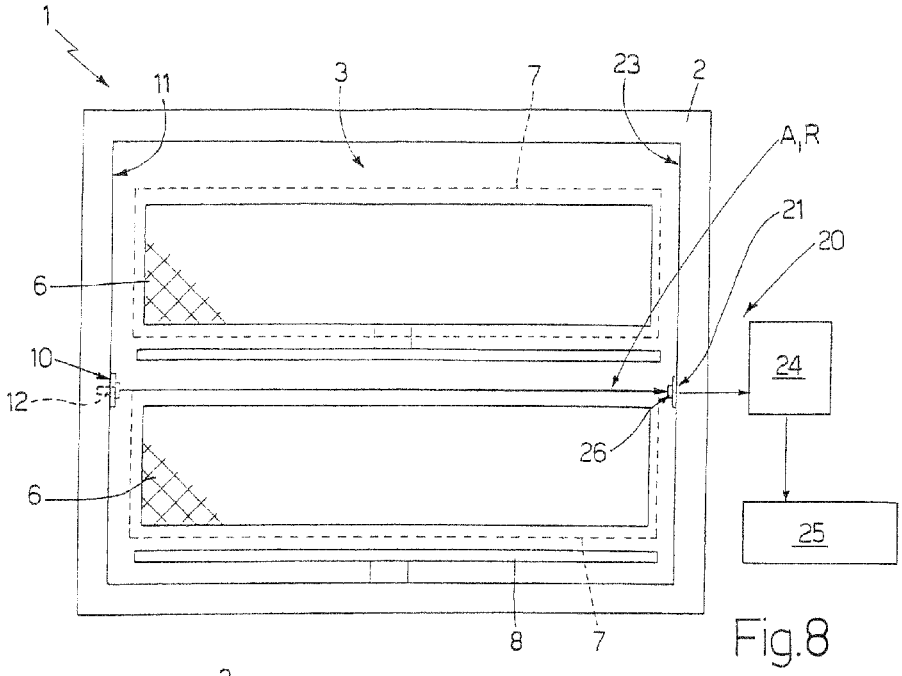
FIG. 8 shows a schematic front view of the dishwasher comprising an alarm device in accordance with one possible embodiment of the present invention.

With reference to FIG. 8, detecting unit 20 substantially comprises a detecting device 21 fitted to lateral wall 23 of wash chamber 3 to receive the light beam/s emitted by emitting device 10, and to generate an alarm signal on detecting the absence of at least one of the predetermined light beams, caused by interruption of the light beam by the dishes/cutlery.

More specifically, detecting device 21 may comprise one or more photoreceiving devices 26, e.g. photodiodes, each for receiving a light beam emitted by a corresponding LED 12. More specifically, in the FIG. 8 example, in which emitting device 10 comprises only one LED 12, detecting device 21 is fixed firmly to the wall 23 of wash chamber 3 facing wall 11 fitted with LED 12, and is located at the point of incidence of the light beam emitted by the LED. Obviously, in the event emitting device 10 comprises a number of LEDs 12, detecting device 21 comprises a number of photodiodes, each fitted to lateral wall 23 and aligned with the corresponding LED 12 to receive the relative light beam.

Detecting device 21 also comprises an electronic unit 24, and an indicator device 25.

More specifically, indicator device 25 may comprise an acoustic and/or visual indicator module defined, for example, by a LED, or by a display for displaying a message indicating incorrect positioning of the dishes/cutlery inside basket 6; and electronic unit 24 may be defined by a signal processing circuit or a microprocessor connected to detecting device 21 to receive the alarm signal and determine incorrect positioning of the dishes/cutlery. Electronic unit 24 is also connected to indicator device 25 to activate the visual/acoustic message on determining incorrect positioning of the dishes/cutlery.

In connection with the above, it should be pointed out that dishwasher 1 in accordance with the FIGS. 6 and 7 embodiment, i.e. with emitting device 10 fixed to the wall of casing 2 to oscillate about point P, may be equipped with detecting unit 20 to determine not only incorrect positioning of the dishes/cutlery inside basket 6, but also improper support of dishwasher 1 on floor S.

Figure 9:
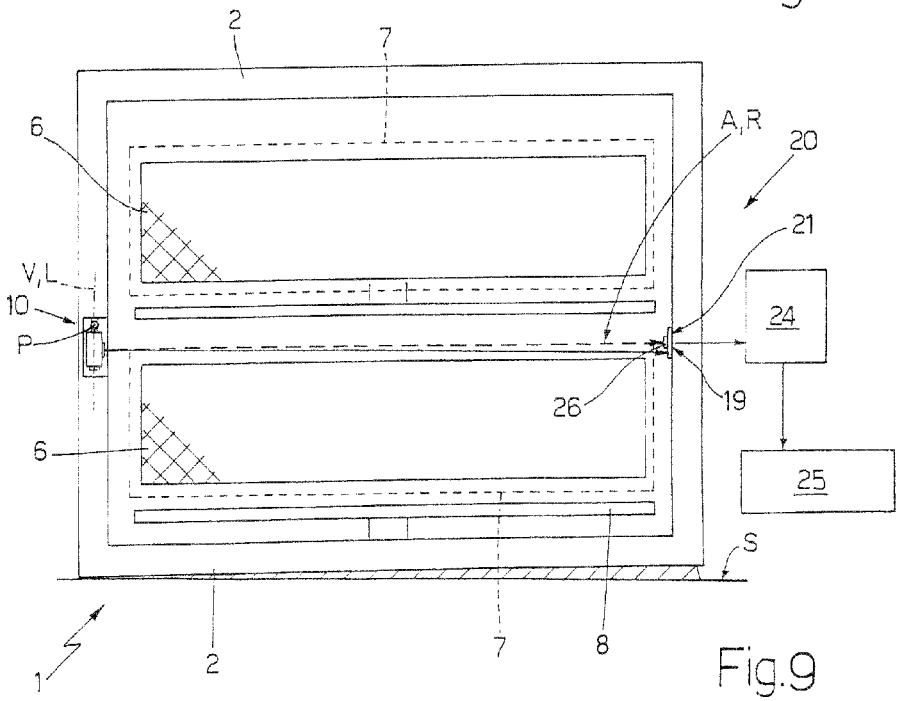
FIG. 9 shows a schematic front view of the dishwasher comprising an alarm device in accordance with a further embodiment of the present invention.

More specifically, as shown in FIG. 9, detecting device 21 may be located at reference element 19 to receive the light beam emitted by relative emitting device 10, and, if the light beam is not received, to generate the alarm signal indicating improper support on floor S.

When installing the dishwasher, in fact, non-reception of the light beam by detecting device 21 (FIG. 9) means the light beam impinges on a point of wall 23 other than reference element 19, thus indicating improper support of dishwasher 1 on floor S. In which case, electronic unit 24, by means of indicating device 25, informs the user by generating a visual/acoustic message indicating improper support of dishwasher 1.

In connection with the above, it should be pointed out that, in the embodiments described employing detecting unit 20, emitting device 10 may comprise LEDs 12 for emitting light beams with a frequency range in the non-visible spectrum.

In actual use, when installing dishwasher 1, detecting unit 20 generates the alarm signal on detecting the absence of a light beam from emitting device 10; and electronic unit 24, by means of indicator device 25, indicates improper support of dishwasher 1 on the floor.

Alarm device 9 of dishwasher 1, as described above, has the major advantage of enabling the user to determine practically immediately incorrect positioning of the dishes/cutlery in basket 6, thus reducing the risk of damage to the dishes/cutlery and, at the same time, preventing jamming of the rotary wash members, thus ensuring correct performance of the wash cycle.

Moreover, provision of detecting device 21 at reference element 19 provides, when installing dishwasher 1, for automatically indicating improper support of dishwasher 1 on the floor.

Clearly, changes may be made to the dishwasher and alarm device as described and illustrated herein without, however, departing from the scope of the present invention as defined in the accompanying Claims.

More specifically, in an alternative embodiment (not shown), the detecting device 21 may be located on the casing 2 outside of the wash chamber 3 on one side of the access opening to wash chamber 3 to receive the light beam emitted by relative emitting device 10 located outside of the wash chamber 3.

Figure 10:
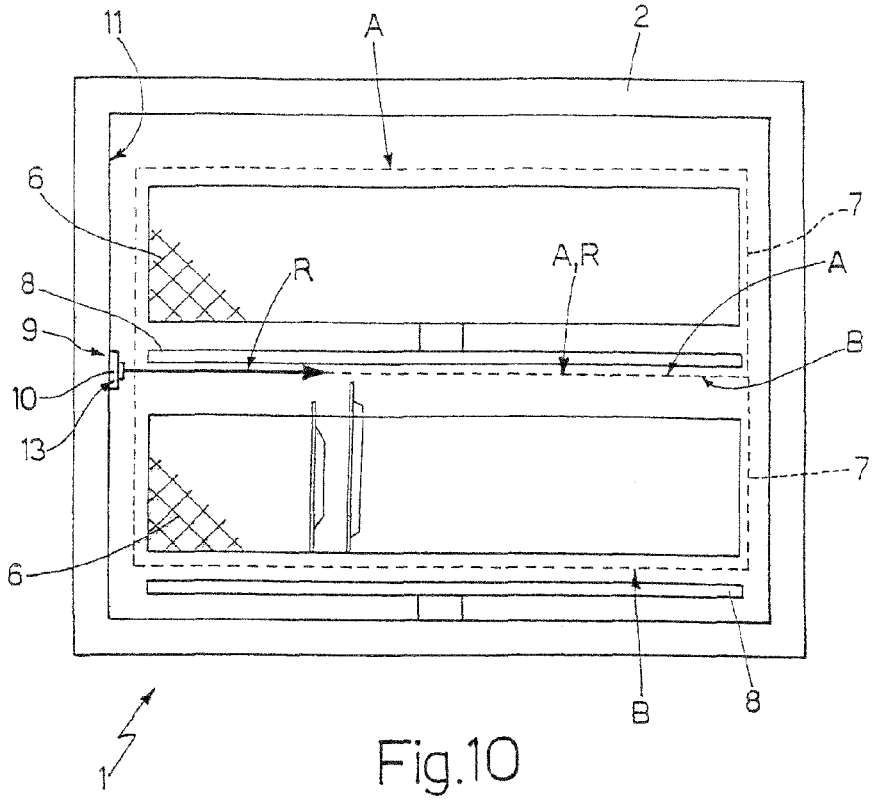
FIG. 10 shows schematic front view with parts removed for clarity of the drawer dishwasher comprising an alarm device in accordance with a further embodiment of the present invention.

In addition, the hold volume 7 of the top basket 6 may have dimensions to contain also the rotary spray wash member 8 arranged below of the basket 6. With reference to example shown in FIG. 10, hold volume 7 of top basket 6 is bounded at the bottom by the horizontal plane B which is located below the spray wash members 8 of the top basket 6. In this case, the light-emitting device 10 of the alarm device 9 is fixed to the lateral wall 11 of wash chamber 3 and emits the light beam along the reference plane R, which lies in boundary plane B of top basket 6 below the rotary spray wash member 8.

Of course it should be point out that hold volume 7 of bottom basket 6 could be bounded at the top by the horizontal plane A which is located shortly below the spray wash members 8 of the top basket 6. In this case, the light-emitting device 10 of the alarm device 9 is fixed to the lateral wall 11 of wash chamber 3 and emits the light beam along the reference plane R, which lies in boundary plane A of bottom basket 6 shortly below of rotary spray wash member 8 of top basket 6.

In addition, alarm device 9 of front-loading domestic dishwasher 1 described above could be used in a "drawer dishwasher", (FIGS. 11-21) which is a known dishwasher 1 having one or a number of modular extractable dishwasher unit stacked preferably, though not necessarily one above the other forming part of a furniture.

Figure 11:
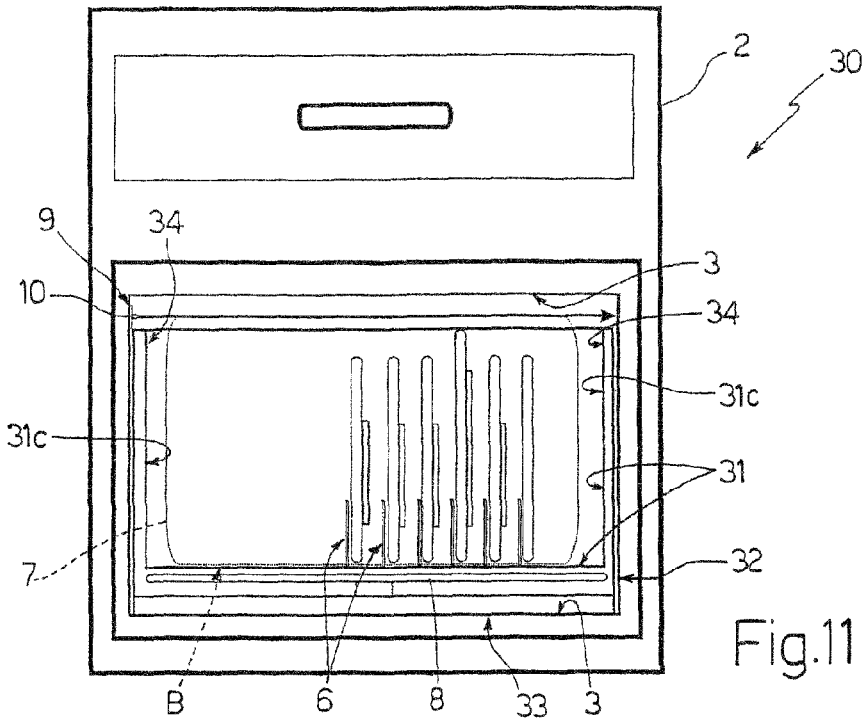
FIG. 11 shows schematic front view with parts removed for clarity of the drawer dishwasher comprising an alarm device in accordance with a further embodiment of the present invention.
Figure 12:
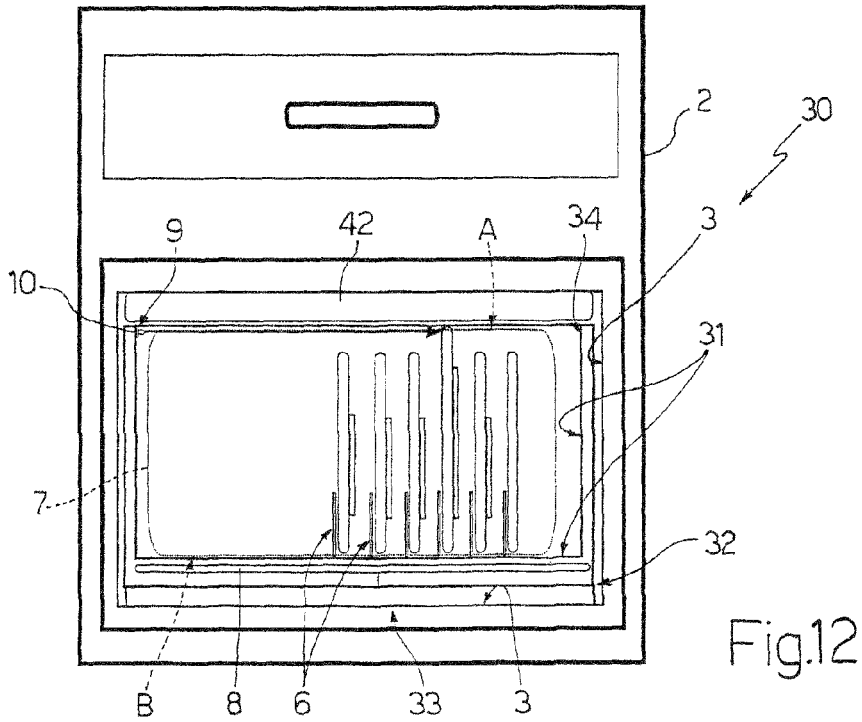
FIG. 12 shows schematic front view with parts removed for clarity of the drawer dishwasher comprising an alarm device in accordance with a further embodiment of the present invention.

For example, the embodiments shown into FIGS. 11 and 12 relate to drawer dishwashers 30 which are similar to front-loading domestic dishwasher 1 and in which their components are numbered, where possible, with the same reference numbers of identical components of dishwasher 1.

With reference to examples shown in FIGS. 11 and 12, wash chamber 3 of the drawer dishwasher 30 comprises a wash tub 31 which is embodied as an extractable drawer 32 to house the dish rack 6 and supporting dishes/cutlery.

In detail, the extractable drawer 32 is slidably mounted within wash chamber 3 on known support runners (not shown) to move between a first position (shown in FIG. 13 or 15), wherein extractable drawer 32 is entirely on the inside of wash chamber 3 to enable dish/cutlery washing cycle, and a second position (shown in FIG. 14 or 16), wherein extractable drawer 32 is pulled out of wash chamber 3 to enable the user to place dishes and/or cutlery properly inside of the wash tub 31.

With reference to examples shown in FIGS. 11 and 12, the extractable drawer 32 comprises a front wall 31*a*, a bottom wall 31*b* and opposite side walls 31*c* that collectively define the wash tub 31. In a manner also known in the state of the art, wash tub 31 of the extractable drawer 32 has a upper opening 34 to enable the user to place dishes and/or cutlery properly inside of wash tub 31.

The extractable drawer 32 has a predetermined, preferably parallelepiped-shaped hold volume 7 (shown by the dotted line in FIGS. 11-16), the outer walls of which define a predetermined space in which to house dishes/cutlery. In other words, hold volume 7 defines a predetermined space, within which dishes/cutlery must be housed when positioned correctly, and which is therefore sized to prevent the dishes/cutlery from interfering with the outer peripheral edge of wash chamber 3 when user put drawer 32 into wash chamber 3.

In a manner known in the state of the art, drawer dishwasher 30 also comprises a known washing system 33 which is mounted on the extractable drawer 32 to wash the dishes and/or cutlery inside of wash tub 31 when extractable drawer 32 is placed completely inside of wash chamber 3 on its first position. In detail, in the example shown in FIGS. 11 and 12 washing system 33 comprises known pneumatic devices (not shown) and/or pump motor (not shown) and a rotary spray wash member 8 mounted for rotation inside of wash tub 31 and having a number of nozzles designed to direct pressurized-water jets onto the rack baskets 6 housed inside wash tub 31 of drawer 32. More specifically, in the FIGS. 11 and 12 example, rotary wash member 8 of washing system 33 is located underneath rack basket 6 and an appropriate distance from boundary plane B of hold volume 7.

Figure 13:
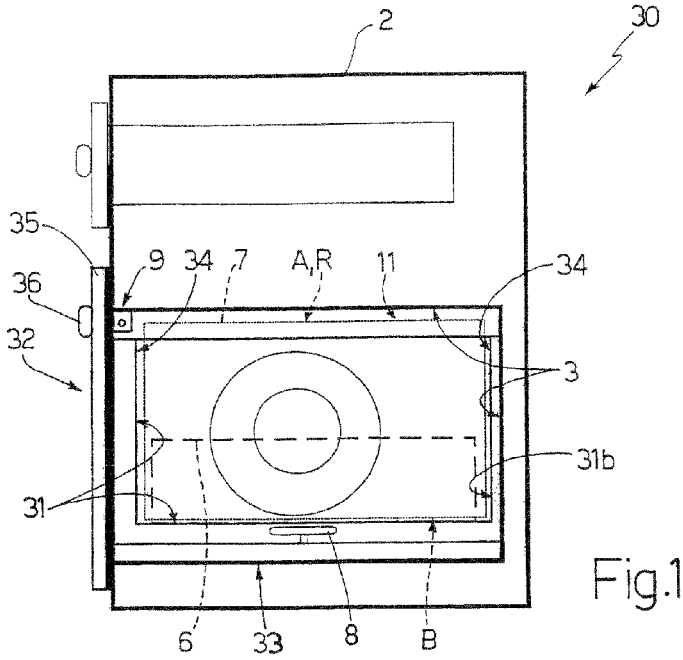
FIGS. 13 and 14 show a schematic lateral view with parts removed for clarity, of the drawer dishwasher of FIG. 11 wherein drawer is in two different positions.
Figure 14:
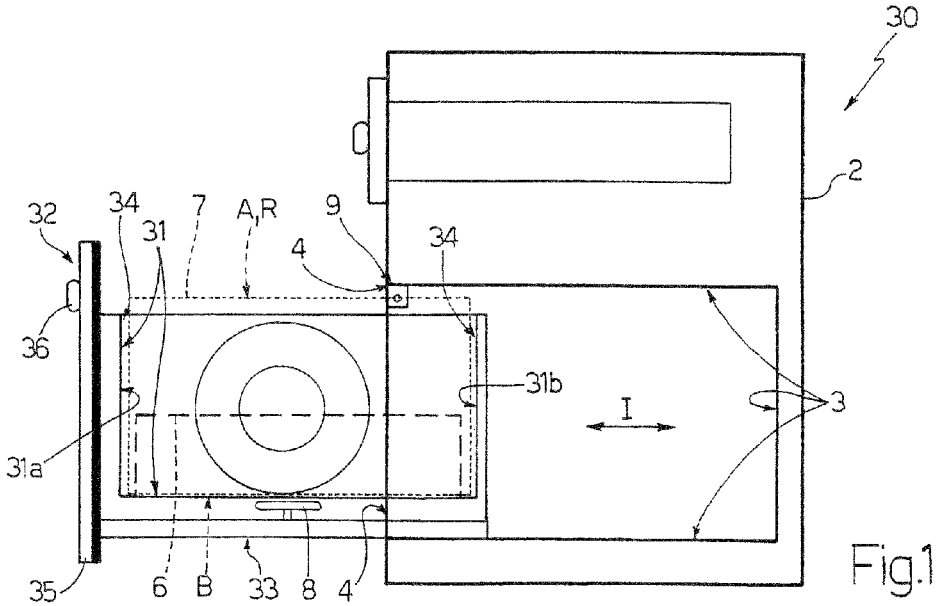

With reference to the embodiment shown in FIGS. 11, 13 and 14, drawer dishwasher 30 also comprises a water-tight vertical front door 35 which is fitted to the front wall 31*a* of wash tub 31 of extractable drawer 32 and preferably, though not necessarily incorporates a drawer pull 36. When fully closed in the first position, water-tight vertical front door 35 abuts the lateral wall of casing 2 to seal the access opening 4 to wash chamber 3.

With reference to FIGS. 11, 13 and 14, alarm device 9 of drawer dishwasher 30 generates, preferably, though not necessarily inside wash chamber 3, at least one light beam along a reference plane R lying boundary plane A and for alerting the user to incorrect positioning of the dishes/cutlery inside wash tub 31 when the light beam is interrupted by the dishes/cutlery.

In other words, alarm device 9 of drawer dishwasher 30 generates at least one light beam in a direction lying in reference plane R, and alerts the user to incorrect positioning of the dishes/cutlery inside wash tub 31 when a portion of the dishes/cutlery projects beyond reference plane R, thus interrupting the light beam.

In the FIGS. 11, 13 and 14 example, the light-emitting device 10 of alarm device 9 is fixed firmly to an inner lateral wall 11 of wash chamber 3 and has a spot light source which emits a light beam along reference plane R, which, in the example shown, lies in boundary plane A.

More specifically, in FIGS. 11, 13 and 14, light-emitting device 10 is fixed firmly to the outer peripheral edge of wash chamber 3 facing opening 4, and is located above the upper rim of the extractable drawer 32 and preferably crosswise with respect to the direction I in which extractable drawer 32 is inserted into and withdrawn from wash chamber 3.

Obviously the light-emitting device 10 may alternatively be located on the casing 2 outside of the wash chamber 3 on one side of the access opening 4 to wash chamber 3 (not shown), to project the light beam outside of the wash chamber 3 in a direction coplanar with reference plane R and crosswise with respect to the direction I in which drawer 32 is inserted into and withdrawn from wash chamber 3.

With reference to FIGS. 11, 13 and 14, in actual use, incorrect positioning of the dishes/cutlery is indicated when, as drawer 32 is inserted inside wash chamber 3, the transverse light beam is interrupted by a portion of the dishes/cutlery housed inside wash tub 31. In which case, the user is usefully alerted immediately by simply observing interruption and/or reflection of the light beam by the dishes and/or cutlery which, when drawer 32 is inserted inside wash chamber 3, project beyond boundary plane A, i.e. intersect reference plane R.

Obviously the alarm device 9 of the drawer dishwasher 30 may alternatively be similar to the alternative embodiments shown in FIGS. 3 and 4, in which emitting device 10 generates a number of separate light beams in straight directions across wash chamber 3.

In addition, the alarm device 9 of the drawer dishwasher 30 may alternatively be similar to the alternative embodiment shown in FIG. 5 wherein, alarm device 9 is designed to continuously and angularly vary the direction of the light beam emitted by emitting device 10.

Furthermore, the alarm device 9 of the drawer dishwasher 30 may alternatively be similar to the alternative embodiment shown in FIG. 6, wherein emitting device 10 is housed inside seat 16 formed in lateral wall 11, and, in addition to support module 14 supporting LED 12, also comprises a connecting member 17, which may be defined by a spherical joint or a supporting arm connecting support module 14 to the top wall of seat 16 at a connecting point P, and allows support module 14 to oscillate freely in any direction with respect to connecting point P.

In addition, the alarm device 9 of the drawer dishwasher 30 may alternatively be similar to the alternative embodiment shown in FIG. 6 wherein emitting device 10 is positioned, by force of gravity, with its longitudinal axis L coaxial with a vertical reference axis V, regardless of the position of casing 2 of dishwasher.

In addition, the alarm device 9 of the drawer dishwasher 30 may alternatively be similar to the alternative embodiment shown in FIG. 8 or 9 wherein alarm device 9 also comprises a detecting unit 20, which detects interruption of the light beam emitted by emitting device 10 inside wash chamber 3 and generates an alarm signal indicating incorrect positioning of the dishes/cutlery inside wash tub 31.

Figure 21:
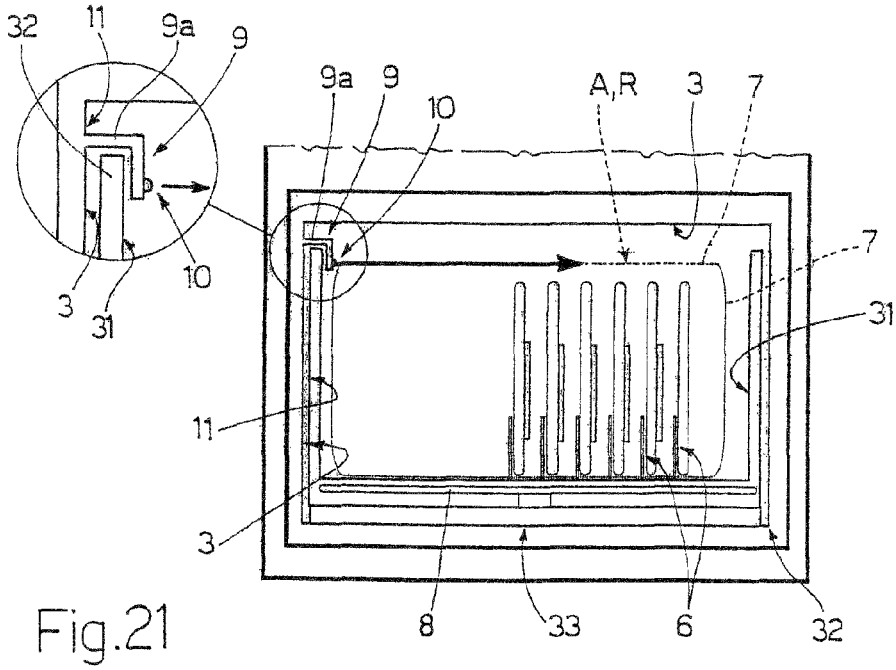
FIG. 21 shows a schematic front view with parts removed for clarity of a portion of the drawer dishwasher of FIG. 11 in accordance with a further embodiment of the present invention.

In an alternative embodiment shown in FIG. 21, alarm device 9 is fixed firmly to the inner lateral wall 11 of wash chamber 3 by and its light-emitting device 10 is placed at least partially inside of the wash tub 31 of the extractable drawer 32 to emit a light beam along reference plane R, which, in the example shown, lies in boundary plane A located under the upper rim of the upper opening of the drawer 32. In detail in the example shown in FIG. 21, alarm device 9 comprises a L-shaped support element 9*a* having an end fixed to the inner lateral wall 11 of wash chamber 3, and the other end which is located under the upper rim of the upper opening of the drawer 32 to support the light-emitting device 10 inside of the wash tub 31.

Figure 15:
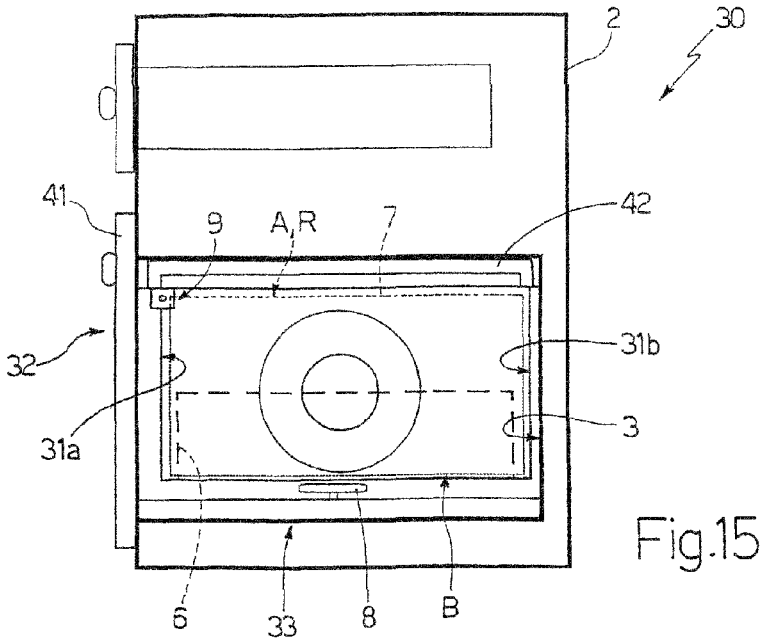
FIGS. 15 and 16 show a schematic lateral view with parts removed for clarity, of the drawer dishwasher of FIG. 12 wherein drawer is in two different positions.
Figure 16:
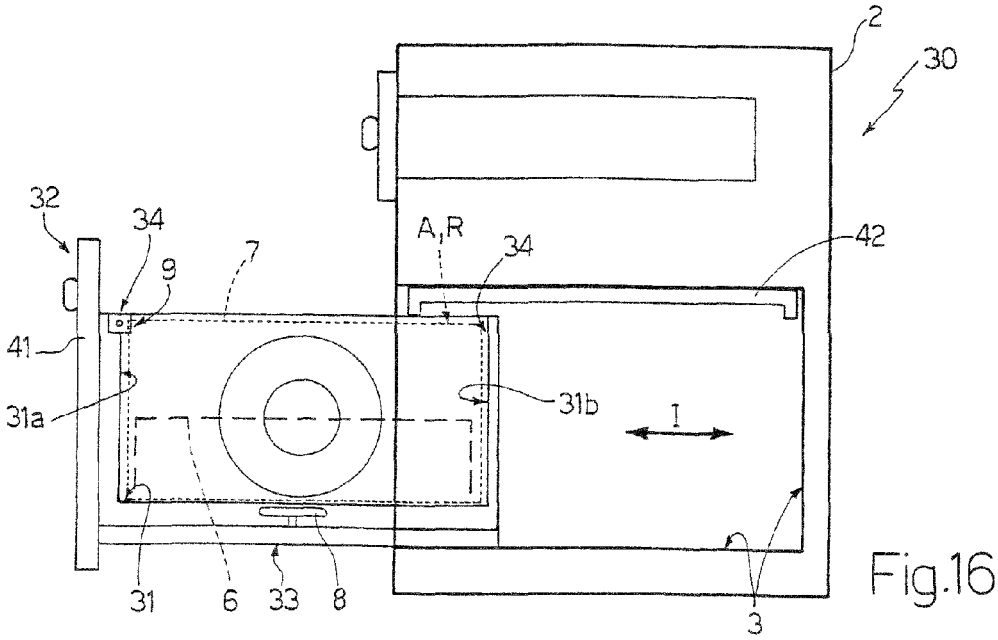

FIGS. 12, 15 and 16 show a different embodiment of drawer dishwasher 30 which comprises a door 41 fitted to the front wall 31*a* of wash tub 32, whereas the washing chamber 13 comprises an upper lid 42 sealing the wash tub 31 when extractable drawer 32 is inserted into washing chamber 3. In a manner also known in the state of the art, lid 42 is able to enter into a water-tight sealing cooperation with the drawer's upper opening 34 upon pushing the drawer 32 into the washing chamber 3.

Figure 17:
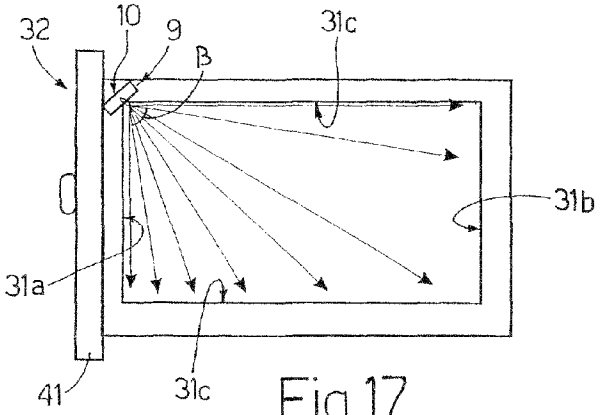
FIGS. 17-20 show schematic top views with parts removed for clarity, of the drawer of the dishwasher of FIG. 12 in accordance with four different embodiments of the present invention.

With reference to FIGS. 12, 15 and 17, the light-emitting device 10 of alarm device 9 is fixed firmly to a wall of the wash tub 31 and has a spot light source emitting a light beam along reference plane R, which, in the example shown, lies in the boundary plane A.

More specifically, in FIGS. 15, 16 and 17, light-emitting device 10 is placed in an angle between to side walls below the upper rim of the extractable drawer 32 to project the light beam in such a manner to cover an angle β of about 90° so as to cover reference plane R.

In detail light-emitting device 10 emits a light blame lying in reference plane R and indicating incorrect positioning of the dishes/cutlery upon the dishes/cutlery being intercepted by the light blame.

Figure 18:
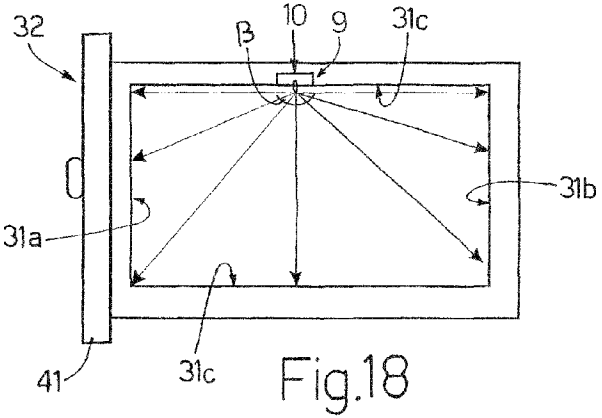

With reference to an embodiment shown in FIG. 18 light-emitting device 10 is placed in a side wall below the upper rim of the extractable drawer 32 to project the light beam in such a manner to cover an angle of about 180° so as to generate a light blame which covers the reference plane R.

Figure 19:
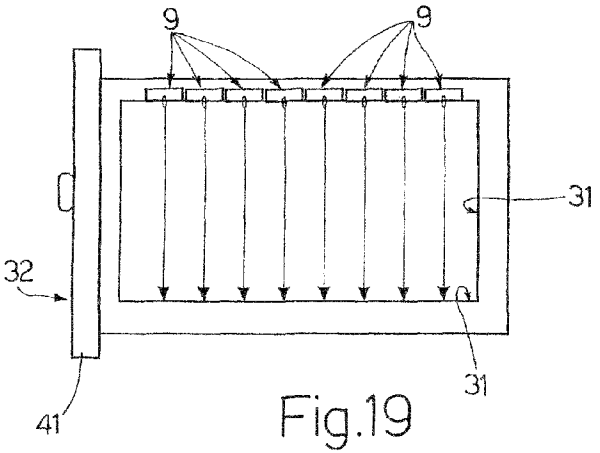
Figure 20:
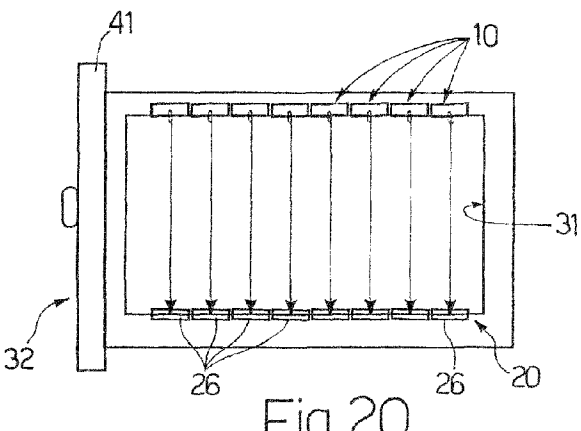

With reference to an embodiment shown in FIG. 19 the alarm device 9 of the drawer dishwasher 30 may alternatively be similar to the alternative embodiment shown in FIGS. 3 and 4, and the emitting device 10 could generate a number of separate light beams in straight directions across the wash tub 31.

Of course it should be point out that the alarm device 9 shown in FIG. 19 could comprise at least a detecting unit 20, which detects interruption of the light beam emitted by emitting device 10 inside of wash tub 31 of drawer 32, and generates an alarm signal indicating incorrect positioning of the dishes/cutlery inside basket 6. In detail with reference to FIG. 20, detecting unit 20 comprise one or more photoreceiving devices 26, e.g. photodiodes, each for receiving a light beam emitted by a corresponding emitting device 10 to generate an alarm signal on detecting the absence of at least one of the predetermined light beams, caused by interruption of the light beam by the dishes/cutlery.

Of course it should be point out that the outer casing 2 of the dish washer 1 or of the drawer dishwasher 30 may have any kind of outer shape, i.e. a rounded shape.

In addition, it should be point out that the lateral wall comprising the opening 4 of the inner wash chamber 3 may be the top wall of the casing 2. In other words the opening 4 of the inner wash chamber 3 could be an upper opening and may be formed in the top wall of the casing 2.

In an alternative embodiment (not shown), alarm device 19 comprises an optical reflecting/refracting system having one or more reflecting or refracting devices (not shown), which receive the light beam emitted by LED 12, and are located into the wash chamber 3 or into the wash tub 31 of the drawer to vary the angle of incidence of the emitted light beam in such a manner to reflect the emitted light beam in a direction coplanar with reference plane R. More specifically the beam emitted by LED 12 is not coplanar with the reference plane R and is reflected by optical reflecting/refracting system in the direction coplanar with reference plane R. Obviously alarm device 19 alerts the user to incorrect positioning of the dishes/cutlery inside basket 6 when the reflected light beam is interrupted by the dishes/cutlery.

The invention claimed is:

1. A dishwasher comprising:

a box-shaped casing having an inner wash chamber that communicates externally through an opening formed in one of the lateral walls of said casing;

at least one dish rack basket housed inside said wash chamber to house dishes/cutlery within a hold volume bounded by two predetermined boundary planes;

an emitting device configured to generate at least one light beam in a direction coplanar with a reference plane lying in one of said predetermined boundary planes;

a detecting device to detect when the light beam is interrupted by dishes/cutlery in said reference plane; and an electronic unit for generating an alert in response to the detecting device detecting that the light beam has been interrupted by dishes/cutlery in said reference plane to alert the user to the dishes/cutlery in said reference plane, wherein none of the at least one light beams are interrupted when the dishes/cutlery are entirely contained within the hold volume.

2. A dishwasher as claimed in claim 1, wherein the two predetermined boundary planes of each hold volume are substantially horizontal and parallel.

3. A dishwasher as claimed in claim 1, wherein said emitting device comprises a light-emitting device located on an inner wall of the wash chamber to project at least one light beam, inside said wash chamber, in a projection direction coplanar with said reference plane.

4. A dishwasher as claimed in claim 3, wherein said light-emitting device emits said at least one light beam in a projection direction substantially crosswise to the direction in which said basket is inserted into and withdrawn from said wash chamber.

5. A dishwasher as claimed in claim 4, wherein said light-emitting device emits a number of light beams in different predetermined directions lying in said reference plane.

6. A dishwasher as claimed in claim 3, wherein said light-emitting device comprises at least one LED.

7. A dishwasher as claimed in claim 6, wherein said LED emits at least one LASER beam.

8. A dishwasher as claimed in claim 6, wherein said light-emitting device comprises at least one support module for supporting said LED; and a connecting member which connects the support module of the LED to an inner wall of the wash chamber, and is designed to allow the support module to move freely with respect to a point connecting said connecting member to the inner wall.

9. A dishwasher as claimed in claim 8, further comprising at least one reference element fixed to an inner wall of said wash chamber at a predetermined point of incidence of the light beam; said predetermined point of incidence corresponding to incidence of the light beam on said wall when the dishwasher is in a level position relative to a floor on which the dishwasher is supported.

10. A dishwasher as claimed in claim 3, wherein said light-emitting device emits a number of light beams in parallel directions lying in said reference plane.

11. A dishwasher as claimed in claim 3, wherein said light-emitting device comprises actuating means for angularly and continuously varying the direction of said at least one light beam emitted by the light-emitting device in said reference plane, so as to sweep the reference plane with said light beam.

12. A dishwasher as claimed in claim 1, wherein said emitting device comprises a light-emitting device to project at least one light beam, and optical reflecting/refracting means located on the casing, which receive the light beam emitted by said light-emitting device to vary the angle of incidence of the emitted light beam in such a manner to reflect the emitted light beam in a direction coplanar with said reference plane.

13. A dishwasher as claimed in claim 1, wherein said emitting device comprises a light-emitting device located on the casing outside of the wash chamber on one side of the access opening to the wash chamber to project the light beam outside of the wash chamber in a projection direction coplanar with said reference plane.

14. A dishwasher as claimed in claim 1, wherein said detecting device is located in said wash chamber.

15. A dishwasher as claimed in claim 14, wherein said detecting device comprises at least one light-detecting device located on a lateral wall of the wash chamber to receive said at least one light beam emitted by said light-emitting device, and to generate a signal when said light beam is not received.

16. A dishwasher as claimed in claim 1, wherein said detecting device is located outside of the wash chamber on one side of the access opening to wash chamber.

17. A dishwasher as claimed in claim 1, wherein said electronic unit comprises visual and/or acoustic indicating means, which receive a signal from said detecting device to generate a visual/acoustic message informing the user of said incorrect positioning of said dishes/cutlery in the relative basket.

18. A dishwasher as claimed in claim 1, wherein said detecting device comprises at least one photoreceiver located on the inner wall of said wash chamber at a predetermined point of incidence; said detecting device, upon non-reception of the light beam by said at least one photoreceiver, the electronic unit generates a signal indicating that the dishwasher is not level on a floor on which the dishwasher is supported.

19. A dishwasher as claimed in claim 1, further comprising at least a rotary wash member located underneath said basket; one of said predetermined boundary planes of the hold volume being arranged below said rotary wash member.

20. A dishwasher as claimed in claim 1, further comprising an extractable drawer having a wash tub, which houses said dish rack basket and has an upper opening; said extractable drawer being slidably mounted within said wash chamber.

21. A dishwasher as claimed in claim 20, wherein said emitting device is fixed on an inner wall of said wash chamber to project at least one light beam on one boundary plane placed above said upper opening of said extractable drawer.

22. A dishwasher as claimed in claim 21, comprising a water-tight vertical front door which abuts a lateral wall of said casing to seal the access opening to said wash chamber.

23. A dishwasher as claimed in claim 20, wherein said emitting device is fixed on an inner wall of said wash chamber by means of a support element, and is placed on the inside of said wash tub to project at least one light beam on a boundary plane placed inside of said wash tub.

24. A dishwasher as claimed in claim 20, wherein said emitting device is fixed on an inner wall of said wash tub to project at least one light beam on a boundary plane placed inside of said wash tub.

25. A dishwasher as claimed in claim 24, wherein said wash chamber comprises an upper lid sealing said wash tub of the extractable drawer.

26. A dishwasher as claimed in claim 24, wherein said detecting device is located in said wash tub.

* * * * *